United States Patent [19]

Goldhammer

[11] 4,354,545

[45] Oct. 19, 1982

[54] MODIFIED PRESSURE CASTING PROCESS

[76] Inventor: Walter M. Goldhammer, 23300 Shaker Blvd., Cleveland, Ohio 44122

[21] Appl. No.: 150,596

[22] Filed: May 16, 1980

[51] Int. Cl.[3] ..... B22D 17/10; B22D 17/32

[52] U.S. Cl. ..... 164/457; 164/113; 164/120; 164/313

[58] Field of Search ..... 164/113, 120, 155, 313, 164/319, 314, 315, 457, 320, 321; 264/328.11, 328.14; 425/550

[56] References Cited

U.S. PATENT DOCUMENTS

| | | | |
|---|---|---|---|
| 2,181,157 | 11/1939 | Smith | 164/120 X |
| 2,398,318 | 4/1946 | MacMillin et al. | 164/113 X |
| 2,904,861 | 9/1959 | Morgenstern | 164/315 X |
| 2,972,172 | 2/1961 | Federman | 164/313 X |
| 3,009,218 | 11/1961 | Rearwin | 164/309 X |
| 3,106,002 | 10/1963 | Bauer | 164/120 |
| 4,066,189 | 1/1978 | Toyoaki et al. | 164/155 X |

FOREIGN PATENT DOCUMENTS

| | | | |
|---|---|---|---|
| 50-37609 | 12/1975 | Japan | 164/113 |
| 52-16424 | 2/1977 | Japan | 164/113 |
| 53-42013 | 11/1978 | Japan | 164/113 |
| 558756 | 7/1977 | U.S.S.R. | 164/113 |
| 728986 | 4/1980 | U.S.S.R. | 164/313 |
| 728987 | 4/1980 | U.S.S.R. | 164/313 |

*Primary Examiner*—Gus T. Hampilos
*Assistant Examiner*—K. Y. Lin
*Attorney, Agent, or Firm*—Maky, Renner, Otto & Boisselle

[57] ABSTRACT

A modified die casting process and machine utilizes a shaped and contained charge of molten metal which is formed and moved proximate the gate runner while the die halves are open. The charge is formed between the shot piston and an ejector side plunger which includes a slave driver rod projecting to engage the shot piston. By confining and compacting the charge, a charge more homogeneous and of uniform temperature is provided. When the die halves close, the shot piston further advances moving the plunger against a stop, retracting the slave driver rod and filling the cavity at the desired flow rate. The cavity is provided with one or more impact absorbing devices positioned in recesses on the parting plane of the die. Each device comprises concentric plungers driven outwardly, first to detect flow and stop the shot piston to avoid peak impact pressure, with the internal plunger then being extended independently to apply compacting pressure to the still molten core of the recess minimizing the volume of any gas trapped in the metal and to feed solidification shrinkage. Accordingly, a more time and energy efficient and less expensive machine and process is provided to obtain high quality die castings.

36 Claims, 26 Drawing Figures

160
161
162
163
164
165
166
167
168
169
170
172
173
174
175
176
177
179
180
182
183
234
235
185
186
187
188
189
192
193
195
196
197
198
199
200
202
203
204
205
206
207
208
210
211
236
237
211
212
213
214
215
216
217
218
220
221
222
223
225
226
227
228
230
232
233
238
239
301

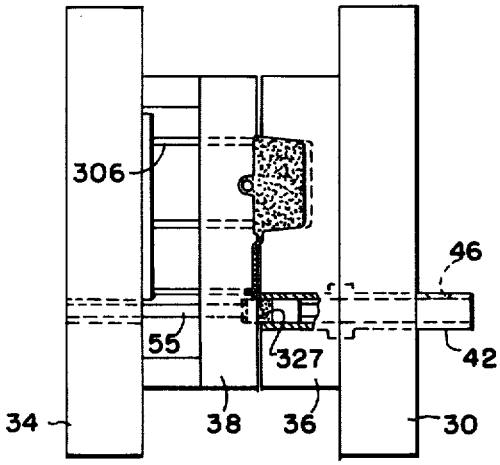
Fig. 18
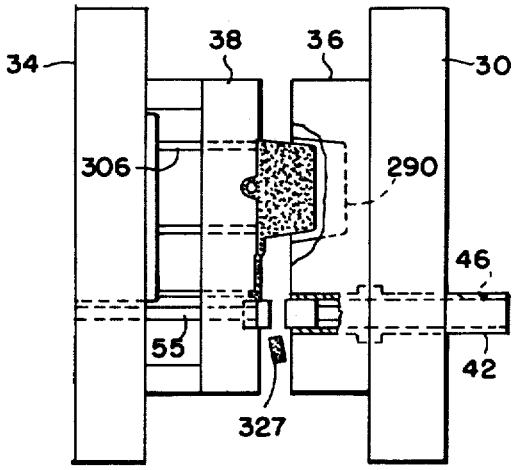
Fig. 19
Fig. 20
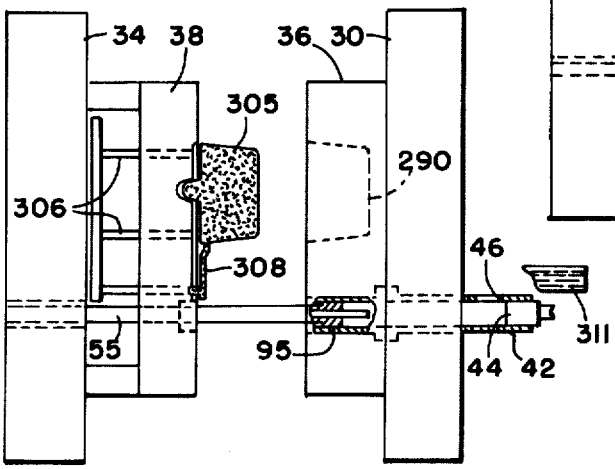
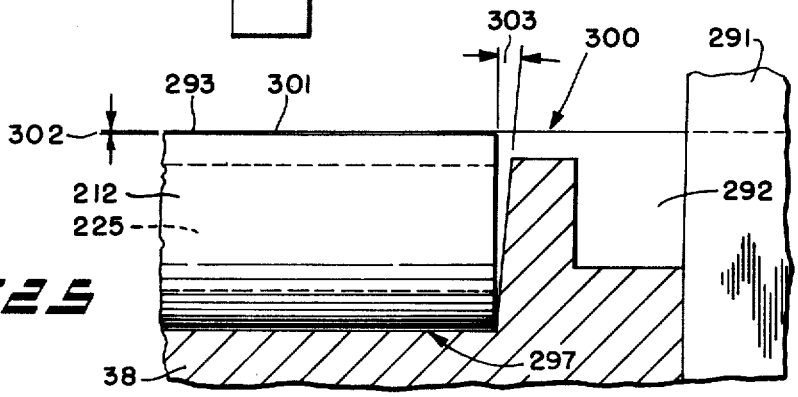
Fig. 25

MODIFIED PRESSURE CASTING PROCESS

This invention relates generally as indicated to a modified pressure casting process and machine and more particularly to a more time and energy efficient die casting process and machine obtaining high quality die castings.

BACKGROUND OF THE INVENTION

Pressure die castings are conventionally made by injecting molten metal under high pressure into permanent dies containing cavities of the desired shape. Such process has been widely used for many years because of its fast cycling speed and accurate reproduction of cavity surface details.

The pressure die casting process characteristically employs rapid metal injection and fast solidification, and uses high compacting forces of thousands of pounds per square inch on the molten metal to reduce the size of voids which may be present due to gases trapped by the turbulent metal flow and shrinkage voids due to rapid solidification.

More recently, a process using only a few pounds of pressure on the metal has come into use and is called "low pressure die casting" to distinguish it from the higher pressure faster cycling "pressure die casting" process. Low pressure die casting is a process in which the molten metal is forced upwardly from an enclosed metal bath through a tube or stalk into a top mounted mold or die held closed by clamping means mounted above the metal bath.

Such low pressure die casting process is designed to move the molten metal slowly in unturbulent flow, and to continue the application of low pressure during slow solidification in order to achieve maximum casting density. This process cycle is measured in minutes instead of the seconds characteristic of conventional pressure die casting. However, low pressure die casting usually requires less massive, and therefore less costly clamping means for the dies and is used to make heavy walled castings requiring high density and uniform metallurgical structure, but not necessarily precise reproduction of cavity surfaces.

Pressure die castings other than low pressure die castings are made generally in two different types of machines. One is called a "hot chamber" machine and has the iron or steel metal injection chamber immersed vertically in the molten casting metal bath. It cannot normally be used for aluminum casting alloys into which the iron or steel of the pressure chamber is readily soluble, thus destroying the required compression fit of the metal injection piston and contaminating the casting alloy. A hot chamber machine also cannot be used for higher melting temperature casting alloys such as brass as the higher alloy melting temperature would lower the strength of the immersed components of the metal injection system which must be operated at high pressure. Aluminum and other high melting point alloys are therefore die cast in a so-called "cold chamber" die casting machine where the injection chamber is not immersed in the molten metal bath. In a cold chamber machine the molten casting alloy is ladled or otherwise charged for each casting cycle into the horizontally disposed pressure chamber through a pouring hole in its upper surface.

The hot chamber die casting process cycles more quickly than the cold chamber process because the molten casting alloy is replaced in the pressure chamber from the metal bath through a side hole which is uncovered after each casting cycle by the upward return stroke of the injection piston. This then provides a fresh charge of metal which only awaits the closing of the die halves before it can be injected into the die. In the present horizontal cold chamber machines, the die end of the metal injection chamber is open until the die halves are closed, making it necessary to delay the pouring of metal into the pressure chamber until after the die halves are closed. This, of course, delays the metal injection during each cycle.

In both the cold chamber and hot chamber machines, the metal injection stroke is rapid, and the mass of the injection piston, its connected actuating mechanism in the hydraulically actuated driving cylinder, and the hydraulic fluid moving into the cylinder represent a substantial mass which is suddenly arrested at the end of the die filling stroke. The result is a sudden rise in pressure in the molten metal in the die which is usually far in excess of the pressure which is needed to fill the cavity. Such sudden rise in pressure is known as the impact pressure peak.

As a consequence, the clamping mechanism must be designed sufficiently strong to contain this impact pressure peak, or the die halves will be separated slightly permitting metal to escape from the cavity at the die parting line. This flashing causes dimensional discrepancies in the castings and makes flash removal a necessity. If the clamping force is inadequate and the impact pressure peak great enough, the molten metal may be forced out with such speed that it will not solidify on the parting line faces of the die and it will escape at high velocity. All casting machines sold are therefore required to have enclosures which cover the die parting plane during metal injection.

In addition to the undesirable impact pressure peak, the injection systems are actually designed to apply a compacting pressure greater than the pressure needed just to fill the cavities. This compacting pressure is applied to the metal after cavity fill in order to minimize the size of entrapped gas inclusions in the casting and to feed solidification shrinkage of the metal in the casting cavities. This compacting pressure is applied by force exerted in the injection chamber, and it must be transmitted through the solidifying metal both there and in the gate runners, and through the gate orifice before that connection solidifies completely.

Both impact and compacting pressures are in excess of what is actually required to fill the casting cavity and both result in high cost energy consumed, excessive metal in the gate runners and gate orifice, and also in excessive cost of the casting machine injection and clamping mechanism. In the cold chamber process, the metal solidifying on the wall of the injection chamber must be collapsed by the injection piston to advance to its compacting stroke, which increases the energy required for the compacting action.

SUMMARY OF THE INVENTION

It is accordingly a purpose of the present invention to reduce energy required in producing pressure die castings. It is also a purpose to improve die casting production cycle speed while at the same time reducing die casting production and equipment costs. It is also a purpose to improve die casting product quality.

With the present invention the cycle speed is increased by charging molten metal into the horizontal cold chamber while the die is open so that metal injection into the die can be initiated the moment the die halves are closed. This reduces the cost of casting manufacture by speeding the casting cycle. In addition, by modifying the pressure to avoid impact peak pressure and subsequent compacting pressure, it is possible to decrease the casting machine cost as a result of reducing clamping and injection forces required. This in turn reduces energy consumed in the process. Moreover, with the present invention, improved casting quality is obtained by better metallurgical and temperature control during the metal injection and by better position and assured application of the compacting forces during solidification.

The modified pressure aspects of the present invention include a method for absorbing impact pressure, and applying compacting pressure within the die itself, immediately adjacent to the cavity or cavities where it is most effective. The step of eliminating the impact pressure peak is obtained by causing any pressure rise after the cavity is filled to drive outwardly a device or valve element which admits metal flow into a recess occupied by the valve and which motion is immediately detected to generate a signal. The signal is employed to stop further flow of hydraulic fluid into the metal injection or shot piston actuating cylinder before the recess is filled with metal. In this manner, the injection or shot piston is stopped precluding the application of full impact pressure to the metal in the die.

The impact absorbing valve or valves are positioned preferably on the parting plane of the die, close to the cavity outer edge. They are connected to the cavity by the recess in the die parting surface for metal flow, which recess is deeper than the cavity gate inlet so that metal in the latter will solidify first.

The device or valve includes an internal plunger which retracts with the valve, but which plunger can be moved forwardly independently to apply localized compacting pressure to the still molten core of casting metal in the recess, driving the metal backwards under elevated pressure into the cavity to minimize the volume of any gas trapped in the metal and to feed solidification shrinkage of the casting. The impact absorbing valves may be utilized with a vacuum system further to reduce the gases in the cavity.

Positioning of the impact absorbing valve or valves and the associated compacting plungers close to the cavity in the die both speeds response to the impact pressure rise and makes the compacting force more effective than trying to accomplish this through application of control of the movement of the injection or shot piston through the hydraulic system of the machine.

A further aspect of the present invention particularly useful in cold chamber high pressure machines includes a method for closing off the normally open die end of the horizontal cold chamber before the die halves are closed to permit charging molten metal into the cold chamber before die closure. In this manner the machine may be charged with molten metal while the dies are open and the previously made casting is being discharged and the dies are being prepared for the next cycle. This more efficient and rapid charging process is accomplished by advancing an ejector side mounted plunger into the cold chamber, which also provides a means for compressing the molten metal charge into a compact mass minimizing both pre-injection chilling of the metal and the entrapment of gases in the metal in the cold chamber. Moreover, with the present invention the compacted or homogeneous charge of metal may be advanced toward the die end of the compression chamber so that injection of the more controlled metal into the die may be initiated as soon as the dies are closed. The compacted charge being of more uniform temperature assures greater fluidity with less need for super heat in the metal. In addition, the invention aids cavity filling, reduces thermal shock to the die, and decreases the energy needed in injection.

It is accordingly a principal object of the present invention to provide a die casting machine and process which avoids impact pressure peaks.

Aniother object is the provision of such modified pressure process and machine permitting clamping tonage to be reduced thus reducing both the initial coast, the energy needed to operate the process, and reducing wear on the machine and its components.

Still another object is the provision of an impact absorbing device which can be used in cold chamber, or hot chamber dies and machines and which can be applied to new or existing dies and machines.

A further object is the provision of an impact pressure absorbing device which includes a recess acting as a heat sink to assure molten metal flow completion before the casting solidifies.

Another object is the provision of an impact pressure absorbing device which functions without regard to the volume of metal in the injection chamber at the end of the injection stroke.

It is also an important object of the present invention to incorporate in the device which avoids impact pressure peaks a plunger which may be employed locally to apply compacting pressure to the cavity.

Yet another object is the provision of such device which will apply compacting pressure immediately adjacent the cavity and does not require transmission of compacting pressure from a metal injection piston through metal in the cold chamber and also through the gate runners and gate inlet into the cavity.

Still another object is the provision of a casting process and machine incorporating compacting plungers which may be operated more efficiently than is required to collapse and compress solidified metal skin formed in the cold chamber which must be compressed in transmitting compaction force by the metal injection piston.

A further principal object is the provision of a cold chamber machine and process in which the cold chamber may be pre-filled while the dies are still open.

Still another principal object is the provision of such machine and process wherein the cold chamber may not only be pre-filled but wherein the charge may be shaped, confined and moved to a position proximate the gate runner, all while the die halves are open.

Other objects are the provision of a die casting machine and process which permits cold chamber casting of metals normally cast in hot chamber machines without loss of cycle speed.

Further objects are the provision of such die casting process and machine which improves the quality of castings made in cold chamber machines by assuring a compacted mass of molten metal which thereby provides a better controlled and more uniform metallurgical structure and more uniform metal temperature.

Such machine and process also minimizes air entrapment in the metal mass in the cold chamber and also minimizes the amount of metal contamination by lubricants used in the cold chamber.

It is also an object of the present invention to provide a die casting machine and process which reduces the cost of both the die casting process and of the casting machines utilized therein. Such reduced cost is obtained by reducing the compacting pressure required since the metal is maintained more fluid and fills the cavities more easily. The invention also reduces super heat needed in the molten metal to achieve satisfactory cavity filling before solidification and also reduces the amount of energy needed to inject the metal to fill the cavities, and to hold the machine clamp shut.

Other objects and advantages of the present invention will become apparent as the following description proceeds.

To the accomplishment of the foregoing, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

In said annexed drawings:

FIG. 11 is a schematic, hydraulic and pneumatic diagram of the control of the components of the machine;

FIGS. 12 through 20 are sequential schematic illustrations through a complete cycle of a machine of the present invention;

Figure 12:
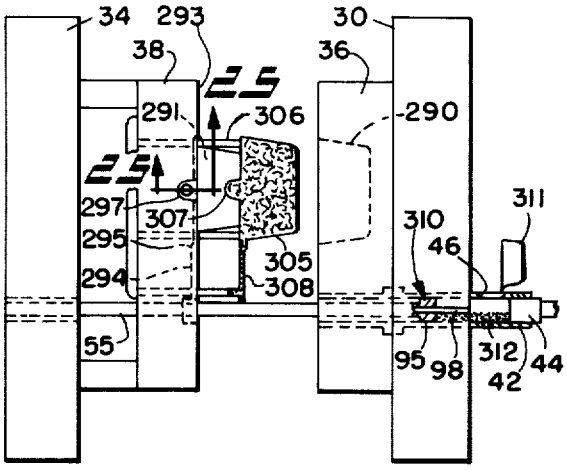
Figure 17:
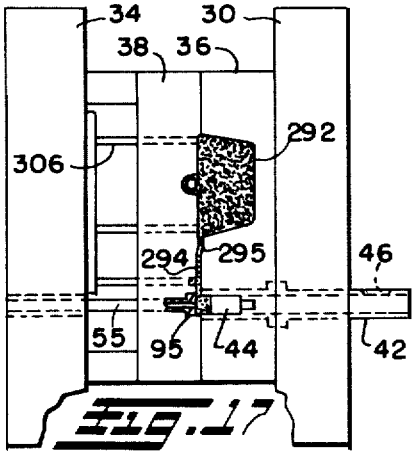

FIGS. 21 through 24 are schematic illustrations at the parting plane of the dies illustrating the location and function of the impact absorbing valve and its associated compacting plunger, such sequence occuring at the conclusion of the cavity filling step of FIG. 17; and FIG. 25 is an enlarged fragmentary section of the neck between the cavity and the impact absorbing valve assembly recess as seen from the lines 25—25 of FIG. 12 or 21.

MACHINE—GENERAL ARRANGEMENT

Figure 1:
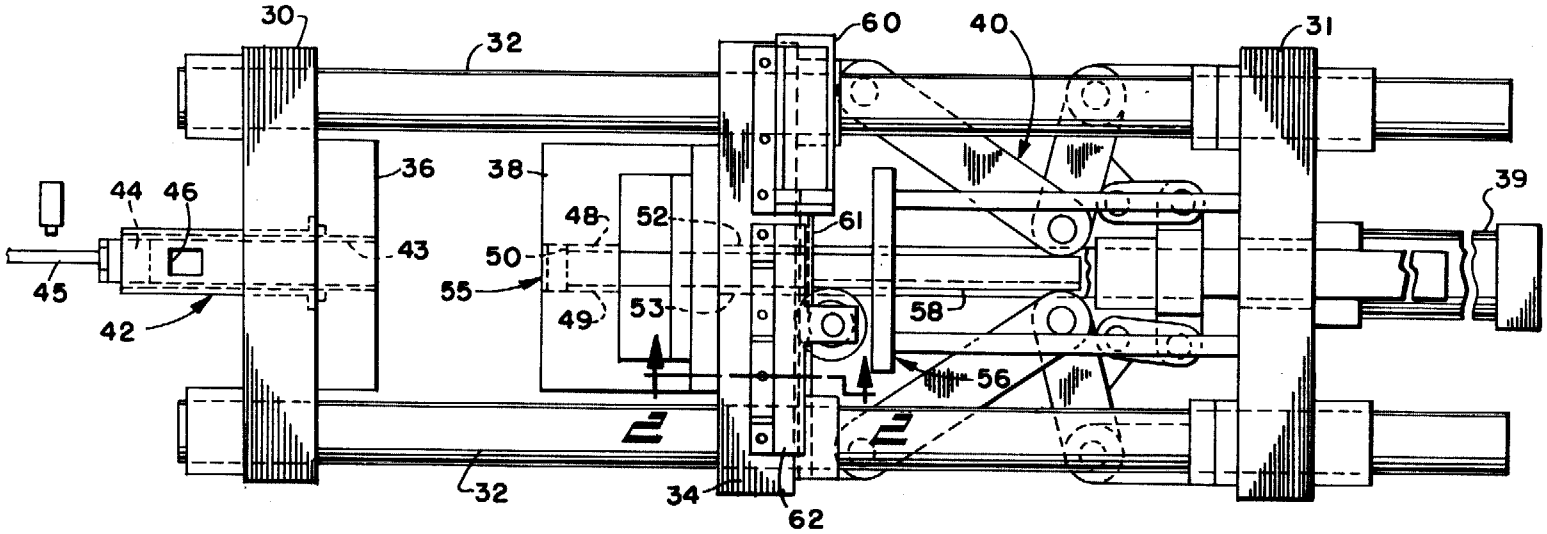
FIG. 1 is a top plan view of a die casting machine in accordance with the present invention.

Referring first to FIG. 1, there is illustrated a die casting machine of the cold chamber type in accordance with the present invention. The machine comprises fixed platen 30 and an adjustable platen 31 interconnected by four tie bars or rods 32 which support for movement therealong an intermediate platen 34. The fixed platen 30 supports what may be termed the cover die 36 while the movable platen 34 supports the opposed ejector die 38. The movable platen and ejector die are moved toward and away from the fixed platen 30 and cover die by piston cylinder assembly 39 actuating toggle clamp mechanism 40 extending between the movable platen 34 and the adjustable platen 31. In FIG. 1 the dies and clamp are shown opened.

Projecting outwardly from the platen 30 is a cold chamber assembly 42 which includes a circular cylindrical cavity extending through the platen 30 and through the lower part of the cover die 36 as seen at 43. Situated within the cold chamber is a reciprocable shot or injection piston 44 mounted on plunger 45. On the top of the exposed part of the cold chamber assembly is a pouring hole 46.

Coaxial with the cold chamber and the shot piston in the bottom of the ejector die 38 is a bore 48 in which is secured a bushing 49 at a recessed stop face 50 in the bore. The movable platen 34 is also provided with an aligned bore 52 accomodating bushing 53. Mounted for axial movement in such bushing is an ejector side plunger shown generally at 55. The ejector side plunger extends rearwardly through the casting ejection bumper plate 56 and has throughout most of its length a rack formed integrally therewith on its side shown at 58. Such rack and thus the ejector side plunger is driven by a horizontally disposed piston-cylinder assembly 60 mounted on top of the movable platen 34. The piston of the assembly 60 drives horizontally extending rack 61 which is mounted for sliding movement in rack frame 62 mounted on top of the platen 34.

RACK ENGAGING MECHANISM

Figure 2:
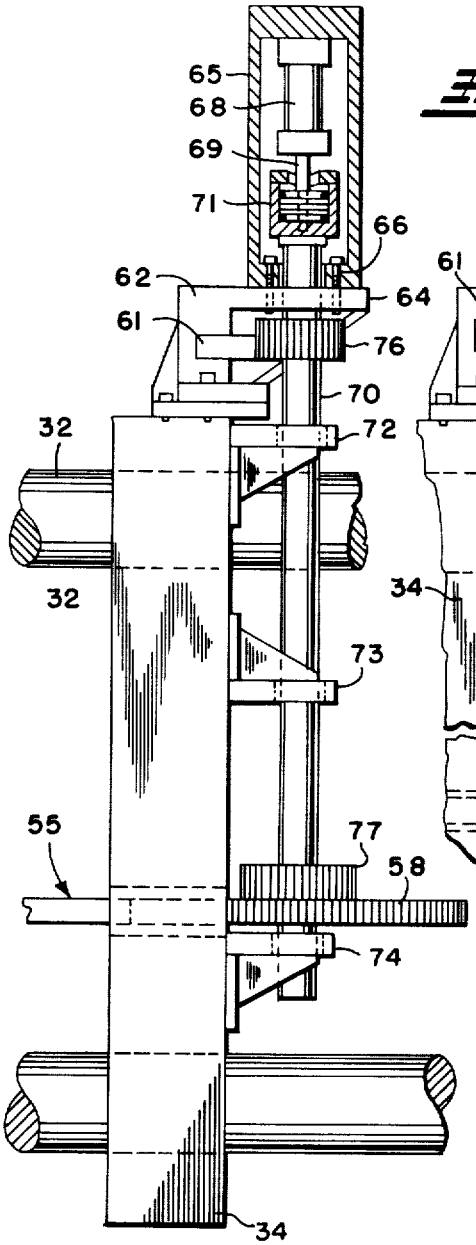
FIG. 2 is an enlarged fragmentary vertical section taken substantially from the line 2—2 of FIG. 1 illustrating the ejector side plunger drive engaging mechanism.
Figure 2A:
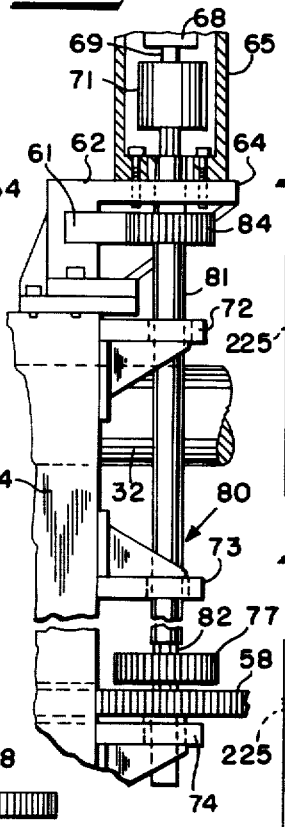
FIG. 2A is a view similar to FIG. 2 illustrating a slightly modified drive engaging mechanism.
Figure 2I:
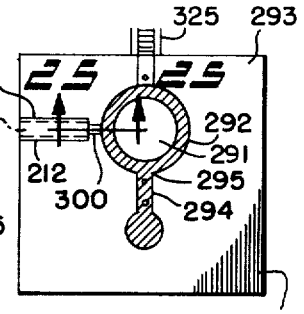
Figure 2J:
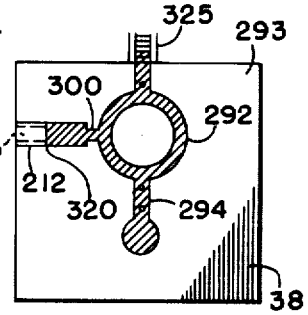
Figure 2K:
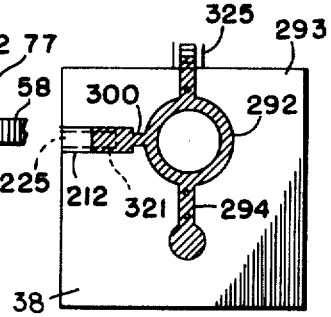
Figure 2L:
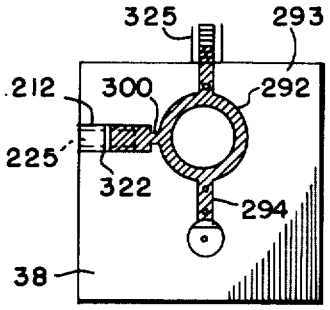
Figure 3:
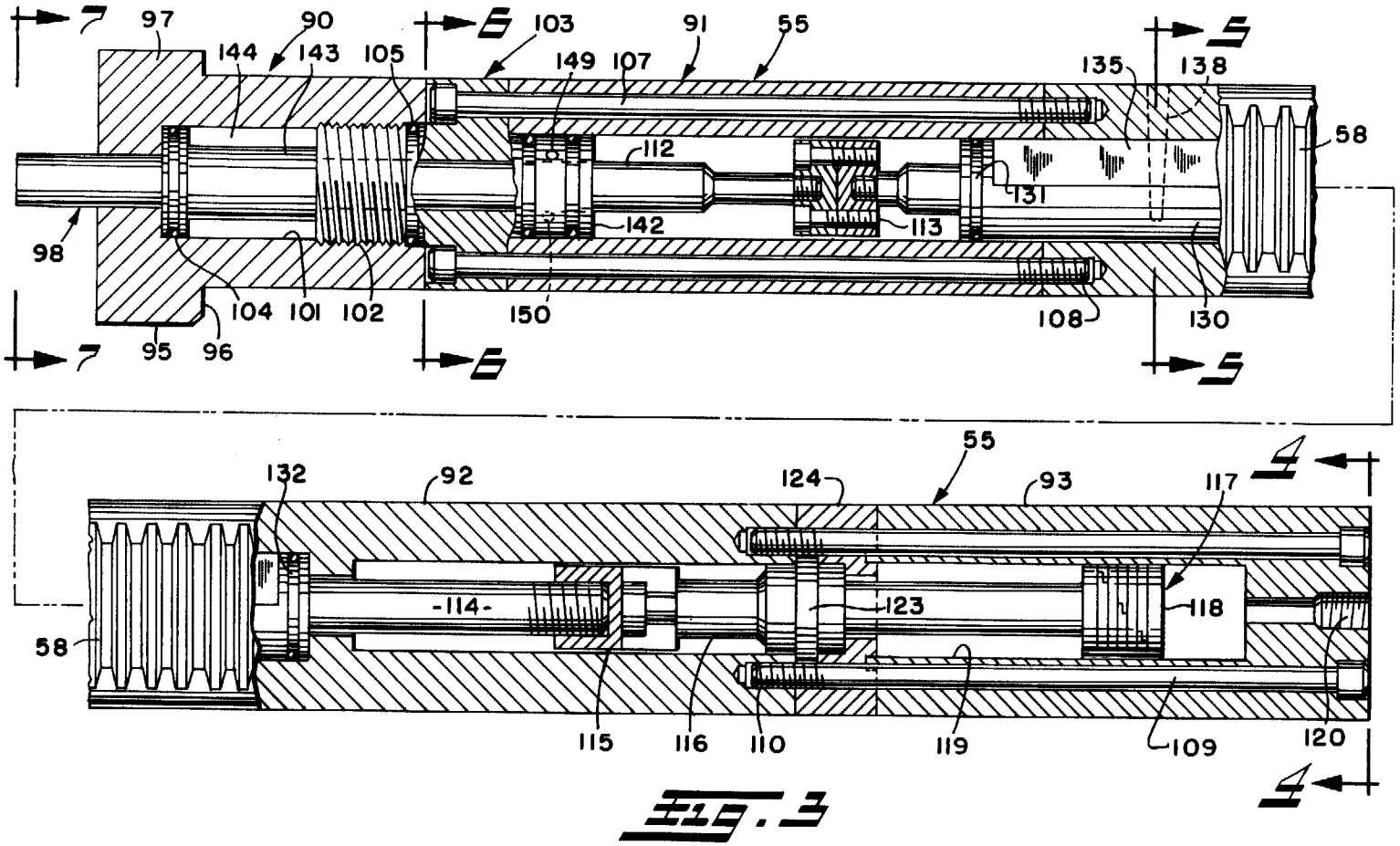
FIG. 3 is a longitudinal enlarged broken section, partly in elevation, of the ejector side plunger.

Referring now in addition to FIGS. 2 and 2A, and first to the preferred embodiment of FIG. 2, it will be seen that the drive 60 for the rack 58 of the ejector side plunger 55 is selectively engageable by the illustrated mechanism. The frame 62 includes a horizontally extending projection 64 on which is mounted cylindrical housing 65. The housing is secured to the projection by the fasteners seen at 66. Situated within the housing 65 is a piston-cylinder assembly 68 the rod 69 of which is connected to vertically extending shaft 70 by the rotary coupling seen at 71. The shaft 70 is journaled in bushings in projecting brackets 72, 73 and 74 extending from the movable platen 34.

Secured to the shaft 70 is a pinion 76 having a width approximately twice that of the horizontally extending rack 61. On the lower end of the shaft 70 there is also secured a pinion 77 adapted to mesh with the rack 58 when the piston-cylinder assembly 68 is extended. When retracted as seen in FIG. 2, the pinion 77 and rack 58 will be out of engagement. Accordingly, the piston-cylinder assembly 68 selectively engages the actuating rack 61 with the ejector side plunger rack 58.

In FIG. 2A, a two part shaft 80 may be employed with the outer part 81 journaled in bushings in the brackets 72 and 73 while the inner part 82 is journaled for rotation only in the bracket 74. The two parts of the shaft may be spline connected. In this manner the pinion 84 secured to the outer part 81 only is not as wide as the pinion 76. The pinion 77 is mounted on the inner part 82 only. With either embodiment, the rack 61 is selectively engageable through the two pinions by reciprocation of the rod 69 of the piston-cylinder assembly 68.

EJECTOR SIDE PLUNGER

Referring now more particularly to FIGS. 3 through 7 it will be seen that the ejector side plunger may be formed in four sections. Reading from left to right in the broken continuation of FIG. 3, it will be seen that the sections are the ejector side plunger tip 90, a forward body 91, an intermediate section 92, and a slave driver rod actuator or end section 93.

Figure 7:
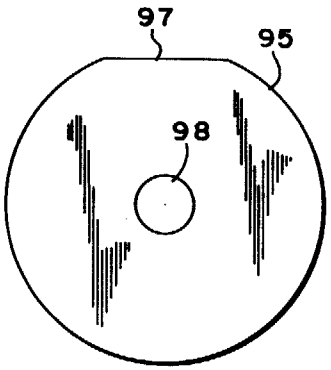
FIG. 7 is an opposite end elevation of the plunger as seen from the line 7—7 of FIG. 3.

As seen also in FIG. 7, the tip section 90 includes an enlarged forward end 95 of circular section presenting a rearwardly extending shoulder 96. The enlarged end includes a vent flat 97 on the top thereof and projecting through the end is slave driver rod 98. The circular enlarged end 95 fits within the cold chamber in the same manner as the shot piston 44.

The plunger tip 90 is provided with an internal cylinder chamber 101 which is internally threaded at its open end to receive the threaded projecting end 102 of adapter 103. An O-ring Seal is provided at each end of the chamber 101 as seen at 104 and 105.

The adapter is in turn secured to the forward body of the plunger 91 by elongated fasteners 107 which are threaded into blind tapped holes 108 in the end of intermediate section 92. The slave driver rod actuator or end section 93 is similarly secured to the intermediate section 92 by elongated fasteners 109 threaded in blind tapped holes 110 in the opposite end of the intermediate section 92. As seen from FIGS. 6 and 4, respectively, there may be four such fasteners 107 and three fasteners 109.

Figure 4:
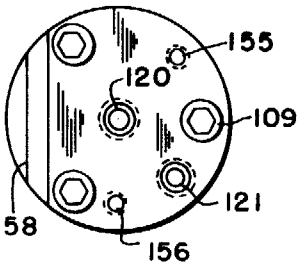
FIG. 4 is an end view of the plunger as seen from the line 4—4 of FIG. 3.

The slave driver rod 98 is formed in two sections, the first being a tip section 112 which is connected through coupling 113 to an intermediate section 114. The intermediate section is in turn connected through slip-on type coupling 115 to the rod 116 of the slave driver actuator 117. The actuator is in the form of a double acting hydraulic piston-cylinder assembly and includes a piston 118 connected to the rod 116 riding in bore 119 in the actuator section 93 of the ejector side plunger. As seen in FIG. 4, fluid to the blind end of the cylinder assembly is supplied through the port 120. Fluid to the rod end may be supplied through the port 121 extending through the barrel of the section 93. The rod 116 of the actuator extends through a gland or seal assembly 123 which is secured in place between the sections 92 and 93 by adapter 124.

In the relatively long intermediate section 92 the rod 114 extends through sleeve 130 which includes at its ends O-ring seals 131 and 132. The sleeve 130 is provided with diametrically facing flats 134 and 135 which form longitudinally extending chambers 136 and 137 extending longitudinally between the seals and radially between the sleeve 130 and the interior of intermediate section 92. A taper pin 138 is inserted through a mating hole in the intermediate section 92 and through a chordal slot 139 in the sleeve 130 properly to assemble and orient the sleeve within the intermediate section 92.

The tip section 112 of the slave driver rod extends through an extension 142 of adapter 103 which includes double O-rings. The tip section also extends through the adapter 103, its threaded extension 102, and sleeve 143 which includes on its outer end O-ring section 104. The inner extension 142, the threaded section 102, sleeve 143 and the O-ring seal section 104 are all part of adapter 103. The sleeve 143 forms an annular cylindrical chamber 144 in the plunger tip section 90.

Cooling water may be circulated through the chamber 144 and through the chambers 136 and 137 formed by the flats 134 and 135 in the sleeve 130.

Figure 6:
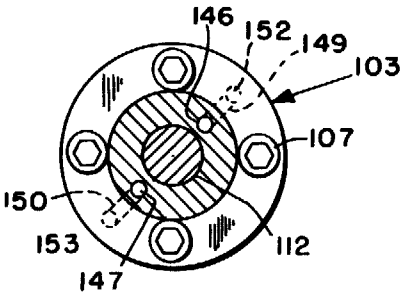
FIG. 6 is a transverse section of the plunger as seen from the line 6—6 of FIG. 3.
Figure 5:
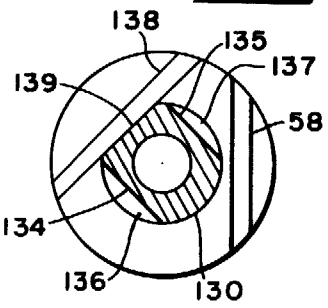
FIG. 5 is a transverse section of the plunger as seen from the line 5—5 of FIG. 3.

As seen in FIG. 6, the adapter 103 may be provided with axially extending bores 146 and 147 which open toward the tip into the chamber 144. Such bores communicate with radially extending passages 149 and 150 in the dual seal extension 142 between the two seals illustrated. Such radially extending passages communicate with axially extending bores in the barrel of the forward body section 91, as seen at 152 and 153 in FIG. 6. Such bores in the barrel of the section 91 extend rearwardly just beyond the seal assembly 131 and communicate with radially extending passages opening into the respective chambers provided by the flats in the sleeve 130.

Just ahead of the seal 132 similar radially extending passages are provided communicating with axial bores in the barrel of the section 92, such bores extending through the adapter 124 and exiting at the end of the plunger as seen at 155 and 156. The axially extending bores or passages in the barrel of the various sections of the ejector side plunger may be provided with O-ring face seals as they pass through the sections 92 and 93 and the adapter 124 therebetween. The rack 58 does not extend throughout the entire length of the ejector side plunger but may extend from approximately the section line 5—5 seen in FIG. 3 to the end away from the tip.

In order to change dies, the ejector side plunger may be extended with the dies fully open and the tip section 90 and forward body section 91 may readily be removed.

IMPACT ABSORBING VALVE

Figures 8, 9, 10:
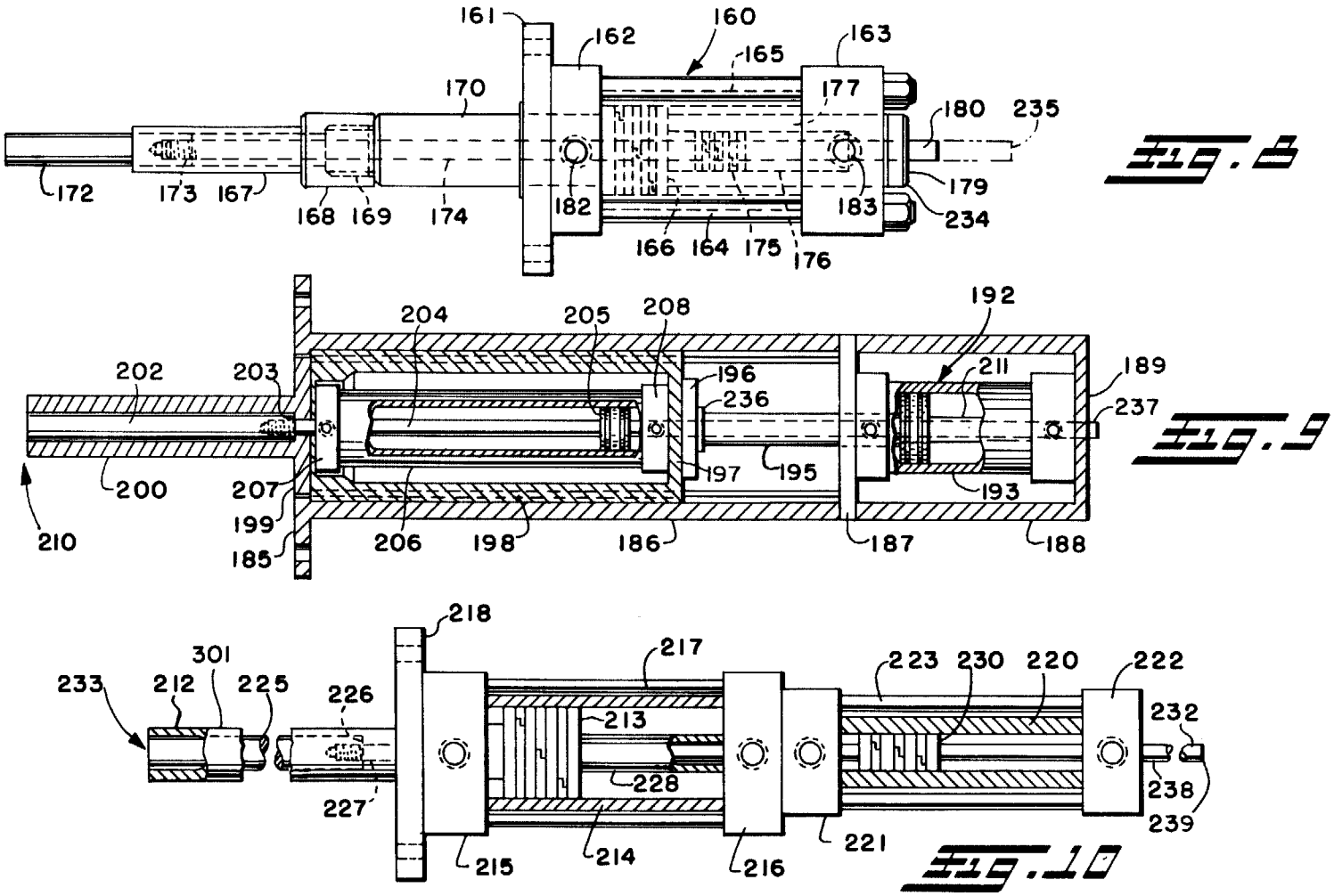
FIG. 8 is an enlarged elevation of one form of impact absorbing valve assembly of the present invention illustrating the compacting rod thereof extended.
FIG. 9 is a longitudinal section of another form of impact absorbing valve assembly with parts thereof broken away and in section.
FIG. 10 is a similar view of yet another form of impact absorbing valve assembly.
Figure 5A:
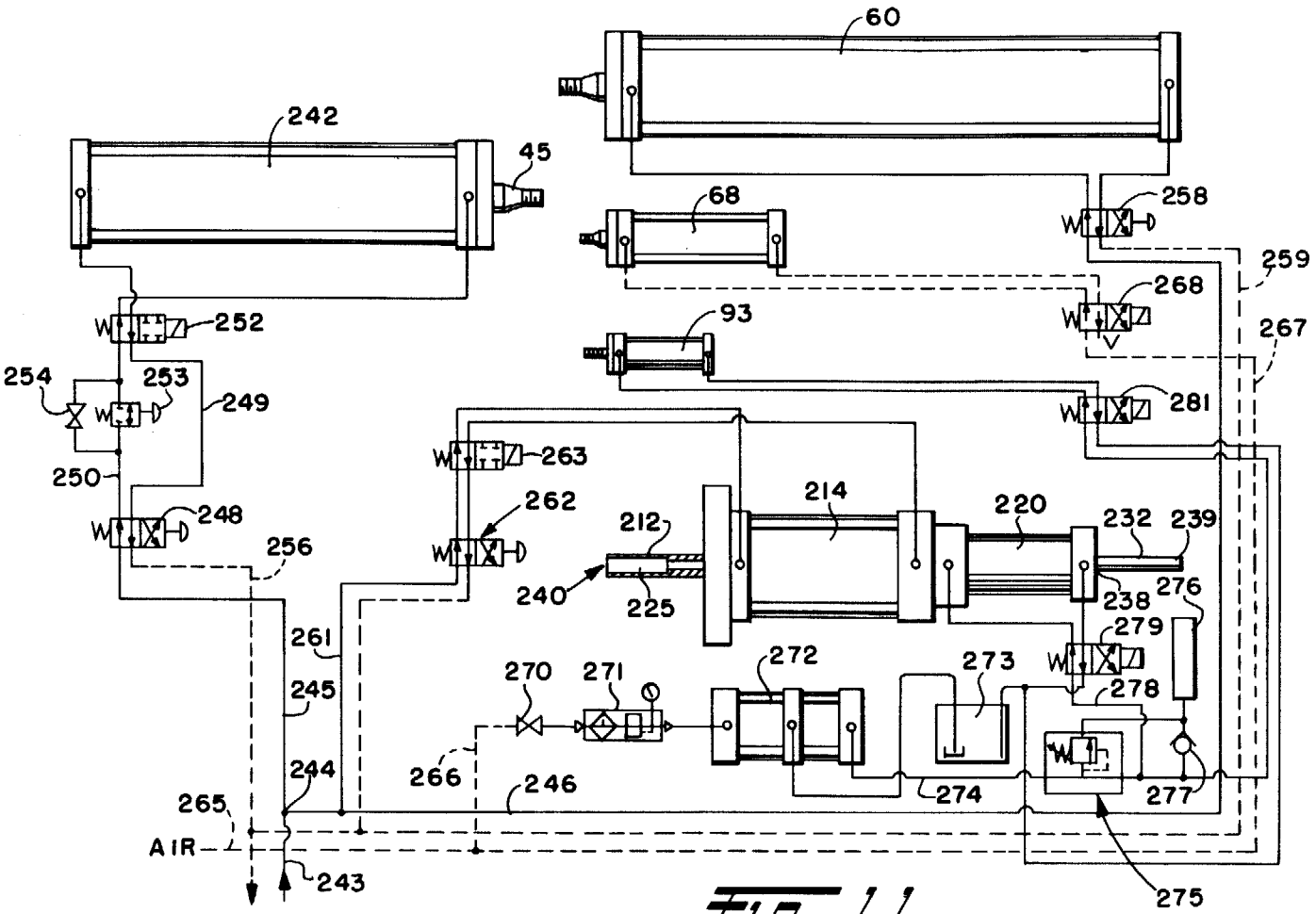

Referring now to FIGS. 8, 9 and 10, there is illustrated three forms of an impact absorbing device which may be utilized with the present invention mounted on the exterior of the dies at the parting plane therebetween. Each comprises concentric plungers which retract under the pressure of the injected metal with the inner plunger being then extended locally to apply compacting pressure.

Referring first to FIG. 8, there is illustrated a compound rod hydraulic cylinder impact absorbing device or valve shown generally in 160 which includes a mounting flange 161 adapted to be mounted on the exterior of the dies. The flange includes a projecting cylinder rod end member 162 from which is supported a blind end cylinder member 163 through the tie rods 164. Cylinder 165 extends between the cylinder ends.

Mounted for reciprocation within the cylinder 165 is a piston 166 which drives the impact absorbing rod 167. The impact absorbing rod includes an enlarged end 168 which is threadedly connected to a threaded projection 169 of the rod 170 connected directly to the piston 166.

Extending axially through the impact absorbing rod 167 is a compacting pressure rod 172 which is threadedly connected at 173 to the rod 174 of piston 175. The connection end of rod 172 abuts against projection 169 when such rod 172 is retracted and in such position the projecting faces of the rods 172 and 167 are flush. The piston 175 is axially reciprocable in the bore 176 of cylinder 177 which is positioned concentrically within the cylinder 165. The cylinder 177 extends rearwardly from the piston 166 and forms an impact absorbing device tail rod indicated at 179. The piston 175 includes a tail rod 180 with both of the concentric tail rods 179 and 180 projecting rearwardly from the cylinder end 163.

The annular exterior piston 166 with its tail rod 179 drives or responds to movement of the impact absorbing rod 167 while the interior piston 175 drives or responds to movement of the compacting pressure rod 172. Ports for the piston 166 may be provided in the cylinder ends as indicated at 182 and 183 in FIG. 8. Ports for the piston 175 may be provided in the end of tail rod 179. In any event, both tail rods are exposed at the rear of the impact absorbing valve or device seen in FIG. 8.

Referring now to FIG. 9, it will be seen that the impact absorbing device includes a flange 185 which may be secured to the exterior of the die. Projecting from the flange is a cylindrical housing 186. The housing includes an end wall 187. Projecting from the end wall 187 is a further cylindrical housing 188 which includes an end wall 189. Extending between the end walls 187 and 189 is an impact absorbing valve driver cylinder assembly 192 which includes a cylinder 193 and a piston 194. The rod 195 of the piston extends through the wall 187 and is connected at 196 to the wall 197 of housing 198. The housing 198 is connected to a front wall 199 which also includes projecting impact absorbing plunger 200.

The internal or compacting plunger 202 shown retracted, seats against a shoulder 203 at wall 199 and is connected through rod 204 to piston 205 in cylinder 206. The cylinder ends 207 and 208 are mounted within the housing 198. As indicated at 210, the projecting ends of the plungers are flush when the rod 202 is retracted. Rod 204 also extends through sleeve 211 in cylinder 192 and emerges as a tail rod from end wall 189 as shown.

Referring now to the embodiment of FIG. 10, there is illustrated a tandem concentric cylinder arrangement for the impact absorbing rod as well as the compacting pressure rod with the impact absorbing rod 212 being connected to piston 213 in cylinder 214. The cylinder ends 215 and 216 are interconnected by tie rods 217 with the rod end 215 being mounted on plate 218 to be secured to the exterior of one of the dies.

Cylinder 220 aligned with the cylinder 214 is provided with cylinder ends 221 and 222 interconnected by tie rods 223. The cylinder end 221 is mounted on the larger cylinder end 216. The compacting rod 225 is concentrically positioned within the impact absorbing rod 212 and includes a shoulder stop seen at 226. The reduced diameter rod 227 threadingly connected to the compacting pressure rod 225 extends through sleeve 228 in cylinder 214 and through the cylinder ends 216 and 221 to be connected to piston 230 in cylinder 220. The rod continues through the cylinder end 222 to project to the rear of the assembly as indicated at 232. As in each of the embodiments, when both rods are fully retracted, they will present a flat face seen at 233 which closes the exterior of the recess communicating with the die cavity at a parting plane of the dies. If both rods are circular the face will be circular. However, other shapes are sometimes desirable particularly for the outer plunger, such as the D-shape plunger seen in the operational schematics.

In all three of the embodiments seen in FIGS. 8 through 10, optically coupled switch locations will be provided indicating the impact absorbing rod extended and the compacting pressure rod retracted. In FIG. 8, the respective optically coupled switch locations will be at 234 and 235. In the embodiment of FIG. 9, the respective locations are at 236 within housing 186 and 237 on the projecting tail rod. In FIG. 10, the respective locations are at 238 and 239.

HYDRAULIC AND PNEUMATIC CONTROLS

Referring now to FIG. 11, it will be seen that the shot piston 45 is actuated by injection piston-cylinder assembly 242 with hydraulic fluid being supplied thereto from hydraulic supply line 243. Such supply line branches at 244 with the line 245 supplying the injection cylinder 242 while the line 246 supplies hydraulic fluid to the piston-cylinder assembly 60 driving the rack 61 which in turn moves the ejection side plunger 55.

The branch supply line 245 to cylinder 242 extends to four-way pneumatically operated directional valve 248 with the hydraulic fluid passing through supply line 249 or return line 250 depending upon the position of the valve 248. Both the supply and return lines 249 and 250 pass through an electrically operated dual check or blocking valve 252. Shifting of the valve 252 from the position shown will block all flow to the injection piston-cylinder assembly 242. The return line 250 is provided with a pneumatically operated two-way valve 253 and a manually adjustable globe or flow control valve 254 parallel thereto. When the valve 253 is shifted, flow through the return line is controlled by the setting of valve 254. Hydraulic fluid is returned to the supply through line 256.

Hydraulic fluid to the ejector side driver cylinder assembly 60 passes through pneumatically operated four-way directional control valve 258 with hydraulic fluid returning from such valve through line 259.

A branch hydraulic supply line 261 extends from the line 246 supplying hydraulic fluid to the impact absorbing valve cylinder 214 through four-way pneumatically operated directional valve 262 and also through dual check or blocking valve 263 which is directly electrically operated.

Pneumatic pressure from source 265 extends to lines 266 and 267, the latter extending through electrically operated four-way directional valve 268 to control the ejector side plunger engage piston-cylinder assembly 68. The line 266 extends through manually operated globe valve 270 and through filter-regulator unit 271 to operate air driven hydraulic pump 272.

The pump 272 takes fluid from reservoir 273 and forces it through line 274 through regulator relief valve 275 to accumulator 276. The accumulator is also connected to the supply line 274 through check valve 277. Branch supply line 278 extends through electrically operated four-way directional valve 279 to control the compacting pressure rod cylinder 220. The supply line 274 also extends to electrically operated four-way directional valve 281 controlling the slave driver rod cylinder assembly 93.

It can be seen from FIG. 11 that the injection cylinder assembly 242, the ejector side plunger driver assembly 60, and the impact absorbing cylinder 214 may all be driven from the hydraulic supply line 243 which may be part of the hydraulic system of the machine. The compaction plunger assembly 220 as well as the slave driver actuator 93 are driven from the relatively small air driven pump 272 which generates a low volume supply of high pressure hydraulic fluid.

The directional control valves 248, 262, 279, 281, 268 and 258, may all be controlled electrically, either directly or through an electrically controlled pneumatic valve, from a programable controller for the machine or the machines electric control panel. The check or blocking valves 252 and 263 are electrically actuated from a motion detecting sensor, preferably in the form of an optically coupled infrared motion detector which instantly detects the start of rearward or outward motion of the tail rod 232 when the switch location 238 shifts rearwardly. The check valve 252 may be closed instantaneously stopping further motion of the shot piston and the flow of metal through the die and into the impact absorbing valve recess before the recess is completely filled. This action prevents impact peaking otherwise occuring when the forward motion of the injection piston is suddenly arrested when the die cavity is filled.

A time delay programed into the programable controller, or a timer actuating a relay in the machine main control panel allows sufficient time for the outer skin of metal in the casting cavity and in the impact absorbing valve recess to solidify but leaving a still molten core of casting metal in the valve recess and casting cavity. The programable controller then signals, simultaneously, the valve 263 to close and the valve 279 to shift controlling flow in the high pressure line 278 from the pump to the cylinder 220. This causes the compacting pressure rod to be driven forward while the impact absorbing valve plunger is prevented from moving.

OPERATION

Figure 15:
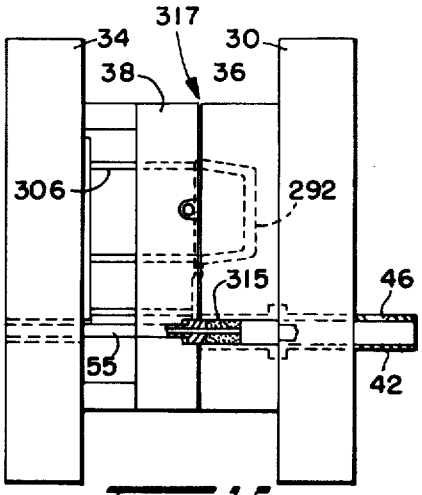

Referring first to FIG. 12, the dies 36 and 38 mounted on the respective fixed and movable platens 30 and 34 are shown opened. For exemplary purposes only, the cover die is shown as containing a recess which mates with a core 291 projecting from the ejector die 38 to form a cup-shape die cavity 292 as seen in FIG. 15.

Beneath the cavity the face 293 of the ejector die 38 is provided with a vertically extending gate runner 294. A reduced section gate inlet is provided at 295 between the gate runner and the cavity. The gate runner provides communication between the cold chamber and the cavity when the dies are closed.

Extending radially from the die cavity in the face 293 of the ejector die 38 is an impact absorbing recess 297 which, as seen more clearly in FIGS. 21 and 25 includes a reduced recess inlet or neck 300 between the recess and the die cavity 292.

As seen also in FIG. 25, it is in the recess 297 that the plungers 212 and 225 of the impact absorbing valve are positioned. As illustrated, the recess 297 is formed completely in the ejector die half although it may be formed in the cover die half. Also, the recess may be partially in both die halves. The impact absorbing valve recess if in both halves of the die should be 0.1 mm per side larger than the valve itself to avoid die clamping pressure from binding the valve plungers thereby preventing free reciprocation when the die is closed.

With reference to FIG. 25, when the recess is in the ejector die half, a 0.1 mm. clearance may be provided between the flat side face 301 of the D-shape, in section, plunger 212 and the parting plane 293 as indicated at 302. Also, the inlet or neck end of the recess is provided with a minimum 2° draft angle as seen at 303. The draft angle exposes the full valve face to incoming metal flow through the neck or inlet 300 from the cavity thus allowing instantaneous direct pressure application over the entire valve face. The draft angle also facilitates removal of the solidified metal in the recess during ejection.

Figure 13:
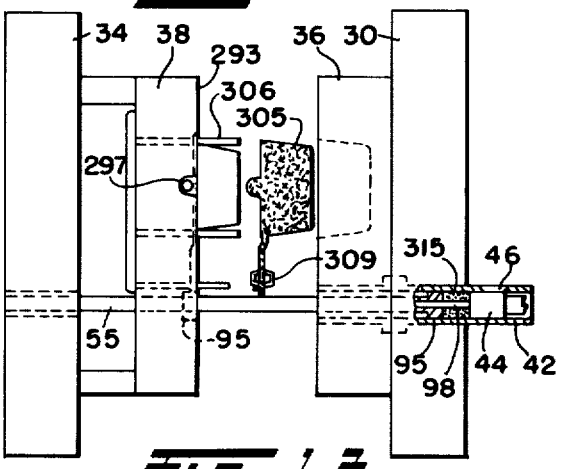

Reverting now to FIG. 12, it will be seen that the dies are open and the casting seen at 305 is being ejected by ejection pins 306. The casting includes a solidified portion 307 formed in the impact absorbing recess and also a solidified portion 308 formed in the gate runner and gate inlet. The casting may be removed from the position shown by an automatic pick-out mechanism 309 as seen in FIG. 13.

In such position of the dies, the ejector side plunger is advanced entering the cylindrical recess of the cold chamber extending to a position 310 which will permit the ladling of molten metal into the cold chamber as indicated at 311. The amount of metal ladled into the cold chamber is that required to fill all recesses to the die including the gate runner, cavities, overflows, lifters and also the impact absorbing valve recess plus a biscuit of residual volume in the cold chamber, but less the volume occupied by the shot piston's advance to cover the pouring hole 46 reduced further by allowance for the projected volume of the flat 97 in the upper surface of the ejector side plunger tip 90 and also for variations in ladling volume consistency, and for the volume of the extended slave driver rod 98.

Such volume may initially fill the cold chamber to approximately the level 312 with the shot piston 44 retracted.

The shot piston 44 is then advanced slowly to close off the pouring hole 46 but to leave exposed the recess or flat in the upper surface of the ejector side plunger tip 90.

When the ejector side plunger achieves the position 310, the slave driver rod is normally retracted. As the shot piston advances, the slave driver rod is also extended to meet the shot piston. The valve 281 is maintained open or in the position seen in FIG. 11 to keep the slave driver rod extended and as the shot piston is extended, the ejector side plunger with the drive of FIG. 2 or 2A disengaged, will be driven back at the same rate as the shot piston advances. This advance of the shot piston driving the ejector side plunger in slave relation therewith advances the now compacted molten charge of metal seen at 315 in FIG. 13 towards the die end of the cold chamber.

Figure 14:
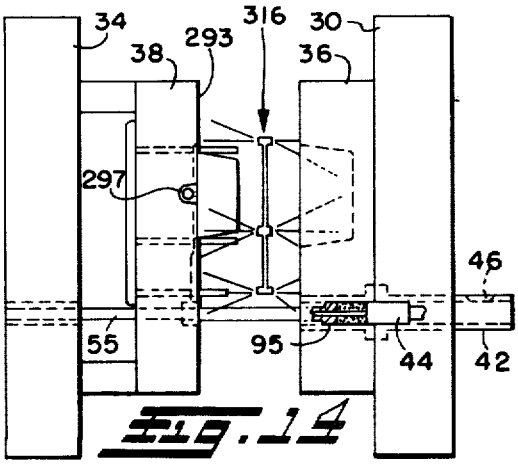

This advance commences as seen in FIG. 13 while the dies are fully open and the casting 305 is being removed. After the casting is removed, the dies may be sprayed as indicated at 316 in FIG. 14.

In FIG. 15 the compacted charge 315 is positioned proximate the face 317 of the cover die and stops. The now completely enclosed and compacted charge waits in the position seen in FIG. 15 for the dies to close.

Figure 16:
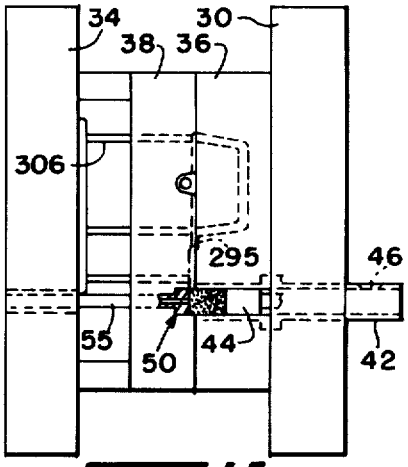

When the dies are closed as seen in FIG. 16 and a vacuum valve, if vacuum is employed, is opened, the shot piston is again advanced and the ejector side plunger is driven back to its original seated position in the ejector die with the enlarged forward end 95 seated against the shoulder 50. The slave driver rod 98 is retracted by reversing valve 281 and the shot piston 44 continues to advance at the desired cavity filling rate of metal flow forcing metal into the cavity through the gate runner 294, the gate inlet 295, and into the casting cavity 292.

When metal has filled the cavity as seen in FIG. 17, it will then flow through the reduced diameter neck 300 into the recess 297. As soon as metal flows into such recess the concentric plungers of the impact absorbing valve start to be driven outwardly. This initial motion is immediately detected by the aforenoted sensor when the optical switch locations 234, 236 or 238 move. The detection of such motion closes check valve 252 to stop further forward motion of the shot piston 44 holding that piston in its advanced position stopping further metal flow into the cavity and thus into the recess 297.

The same signal which detected the first motion of the retraction of the concentric plungers of the impact absorbing valve assembly also starts a timer which when it times out closes dual check valve 263 in the hydraulic line 261 of the impact absorbing valve cylinder 214 to halt its motion. At such time the flush faces of the two plungers may have retracted to the position seen at 320 in FIG. 22. When such timer times out the outer impact absorbing plunger 212, for example, is held in position and the internal compacting plunger 225 is advanced by shifting of the valve 279. The low volume high pressure fluid from the pump 272 then causes the compacting plunger 225 to advance. Such time period or time lapse from the halt of the advance of the shot piston is designed to permit the molten metal in the gate inlet 295 to solidify first before the metal solidifies in the neck portion 300 leading to the recess 297. Accordingly, the gate inlet should be of somewhat smaller cross-sectional area than the neck 300.

As soon as the solidifying metal in the cavity and in the recess 297 has formed a firm outer skin, the compaction plunger rod 225 is advanced at the provided intensified pressure to force metal from the still molten core of the recess 297 back into the die cavity to compact metal in the cavity and offset internal solidification shrinkage of the casting. The compacting plunger 225 may extend, for example, to the position 321 seen in FIG. 23.

When the metal in the recess 297 solidifies, both the compacting pressure rod 225 and the external impact absorbing valve plunger 212 are fully retracted as seen in FIG. 24 to the position indicated at 322 so that the solidified metal in the recess may also be ejected with the gate runner and casting when they are subsequently ejected from the die. When the position 322 is achieved, the vacuum valve may be closed stopping evacuation, and the check valve 252 may be shifted to the open position. As seen in FIGS. 21 through 24, chill blocks 325 may be provided on top of the die in association with a vent or evacuation passageway therethrough as seen in applicant's prior U.S. Pat. No. 3,006,043.

Now referring to FIG. 18, it will be seen that die opening is started. The ejection side plunger engagement drive seen in FIGS. 2 and 2A is now shifted to engage the pinion 77 with the rack 58. The rack and pinion are of course disengaged during the retraction of the ejector side plunger in its slave driven relationship with the shot piston. When such drive engagement is attained the ejector side plunger is advanced to hold the metal biscuit 327 formed in the cold chamber against the shot piston face. This causes the biscuit to shear from the metal solidified in the gate runner with such solidified metal staying in the ejector die recess.

As seen in FIG. 19, as soon as the ejector die moves away from the cover die far enough to shear the gate runner, the metal injection piston is advanced to force the trapped biscuit 327 out of the die end of the cold chamber, moving the ejector side plunger toward the ejector die. The ejector side plunger is then sufficiently retracted separately, while the metal injection piston remains stationary, to allow the cast biscuit 327 to fall free.

The metal injection piston is then retracted to its original position behind the pouring hole 46, as seen in in FIG. 20, and the ejector side plunger is again advanced to enter into the cold chamber as the ejection of the metal casting commences. The metal is then again poured into the cold chamber and the cycle is repeated.

It can now be seen that the compacted and controlled charge of molten metal is formed in the cold chamber and advanced to a position proximate the mating die faces all while the dies are open and such steps are ejection, removal and lubrication are taking place.

Moreover, with the present invention, impact pressure peaks are avoided with the impact absorbing valve limiting the extent of advance of the shot piston with the compacting pressure rod situated locally at the die face applying compacting pressure to offset internal solidification shrinkage.

To one skilled in the art it will be appreciated that a plurality of impact absorbing valves may be employed depending on the configuration of the cavity or cavities in the dies. The dies may also be provided with coolant passages, not shown, to speed and control the solidification process.

Other modes of applying the principles of the invention may be employed, change being made as regards the details described, provided the features stated in any of the following claims or the equivalent of such be employed.

What is claimed is:

1. A die casting process comprising the steps of forming a charge of molten metal and moving such charge to a position proximate a gate runner while the dies halves are open, and then shifting the charge into communication with the gate runner and pressure forcing the charge into the cavity through the gate runner as soon as the die halves are closed.

2. A process as set forth in claim 1 wherein such charge is formed between a piston and a plunger.

3. A process as set forth in claim 2 wherein the step of shifting comprises moving either the piston or plunger with the other being driven therefrom in slave relation.

4. A process as set forth in claim 3 wherein the step of shifting is obtained by moving the piston, extending a slave driver rod from the one to engage the other thereby to cause the plunger to be driven in slave relation to the piston.

5. A process as set forth in claim 4 including the step of extending the piston to move the plunger against a stop to bring the charge into communication with the gate runner.

6. A process as set forth in claim 5 including the step of releasing the slave driver rod and advancing the piston to force the charge into the cavity.

7. A process as set forth in claim 6 including the step of sensing when the cavity is full, and then blocking movement of said piston.

8. A process as set forth in claim 7 including the step of locally compacting the metal in the cavity while the piston is blocked.

9. A process as set forth in claim 1 wherein such charge is formed by first pouring molten metal through a pour hole into a cold chamber between a plunger and the shot piston.

10. A process as set forth in claim 9 wherein such charge is shifted from the pour hole while the die halves are open.

11. A process as set forth in claim 10 including the step of venting the charge at the top of the plunger.

12. A process as set forth in claim 11 wherein such charge is substantially in the form of a right circular cylinder.

13. A process as set forth in claim 1 wherein such charge is approximately the shape of a right circular cylinder.

14. A die casting process utilizing a stationary and movable die adapted to form a cavity which includes a gate runner, forming a charge of metal when the dies are open, moving the charge toward and proximate the die face when the dies are open, and, as soon as the dies are closed, further moving the charge into communication with the gate runner and injecting the charge into the cavity.

15. A process as set forth in claim 14 wherein the charge is formed in a cold chamber extending from the stationary die, and extending a plunger from the movable die into the cold chamber to block the opening of the cold chamber extending from the stationary die face.

16. A process as set forth in claim 15 wherein such charge is first formed by pouring molten metal into such cold chamber through a pour hole between such extended plunger and a shot piston.

17. A process as set forth in claim 16 including the step of advancing such shot piston from behind the pour hole to a position in front of the pour hole to confine and shape the charge between the plunger and shot piston.

18. A process as set forth in claim 17 including the step of driving the plunger into the cold chamber and then disengaging such drive.

19. A process as set forth in claim 18 including the step of extending a spacer rod from either the plunger or piston to set the spacing thereof and the volume of the metal charge.

20. A process as set forth in claim 19 including the step of utilizing the spacer rod to drive the plunger in slave relation to the piston to move the charge proximate the die face.

21. A process as set forth in claim 14 including the step of arranging an impact pressure absorbing device in communication with the cavity operative to retreat and enlarge the cavity when the cavity fills with molten metal, and halting further injection of molten metal into the cavity in response to the retreat of such device.

22. A process as set forth in claim 21 including the step of compacting the molten metal at such device after further injection of molten metal into the cavity has been halted.

23. A process as set forth in claim 21 wherein such metal is injected into the cavity by a hydraulic piston, and such impact absorbing device upon retreat blocks movement of such hydraulic piston.

24. A die casting method as set forth in claim 23 wherein such device as it retreats forms a protrusion of metal, such device including a high pressure plunger operative to push the still molten core of the protrusion toward the cavity after the hydraulic piston has been blocked.

25. A process as set forth in claim 24 wherein the connecting passage to the protrusion formed has a larger cross-section than the inlet gate to the cavity.

26. A process as set forth in claim 24 wherein such impact pressure absorbing device comprises concentric pistons exposed at a common end to such protrusion of metal.

27. A process as set forth in claim 26 including the step of advancing the innermost piston at high pressure after both have retreated.

28. A process as set forth in claim 23 including a plurality of such impact pressure absorbing devices.

29. A process as set forth in claim 27 including the step of blocking the other piston while the innermost piston is advanced.

30. A process as set forth in claim 27 including the step of advancing the innermost piston at a timed interval after further injection of metal into the cavity has been halted.

31. A process as set forth in claim 27 including the step of retracting such innermost piston after the metal has solidified.

32. A process as set forth in claim 21 wherein such impact absorbing device is provided in a recess in a parting plane of the die.

33. A die casting process comprising the steps of forming a charge of molten metal between an injection piston and a plunger and extending the injection piston while moving the plunger in slave relationship to move the charge adjacent the die face while the dies are open, and then further extending the injection piston when the dies are closed to cause the plunger to seat in a stop when the charge is in communication with the gate runner, with further movement of the injection piston forcing the charge into the die cavity.

34. A process as set forth in claim 33 wherein the injection piston is in a cold chamber and including the step of extending such plunger into the cold chamber to close the die face end thereof.

35. A process as set forth in claim 34 wherein the cold chamber is in a fixed die while the stop and the plunger are in the movable die.

36. A process as set forth in claim 35 including a slave driver rod which is extended from the plunger when in the cold chamber to set the spacing between the plunger and piston and to drive the plunger when the piston is extended.

* * * * *